US007331257B2

(12) United States Patent
Lin

(10) Patent No.: US 7,331,257 B2
(45) Date of Patent: Feb. 19, 2008

(54) RETURNING ASSEMBLY OF SPANNER

(76) Inventor: Tsung-Da Lin, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 11/402,021

(22) Filed: Apr. 12, 2006

(65) Prior Publication Data

US 2007/0240543 A1 Oct. 18, 2007

(51) Int. Cl.
*B25B 13/00* (2006.01)

(52) U.S. Cl. ..... 81/58.1; 81/59.1; 81/60

(58) Field of Classification Search ..... 81/58, 81/58.1, 59.1, 60, 61, 63.1, 63.2
See application file for complete search history.

(56) References Cited

U.S. PATENT DOCUMENTS 6,067,881 A * 5/2000 Albertson ..... 81/59.1
6,854,362 B1 * 2/2005 Huang ..... 81/60
7,069,819 B2 * 7/2006 Albertson et al. ..... 81/57.39
2002/0083799 A1 * 7/2002 Albertson ..... 81/59.1

* cited by examiner

*Primary Examiner*—Jacob K. Ackun, Jr.

(57) ABSTRACT

A returning assembly of a spanner includes a driving portion having a receiving space for receiving a driving head, a switch unit and an ejecting unit having a truncated conic shape; a radial direction of the driving head having a slightly inclined buckling surface; the buckling surface and an inner wall of the receiving space being formed with a semilunar buckling space for receiving the ejecting unit; the ejecting unit serving for controlling the returning directions of the driving head. A round cylindrical positioning portion extends from the larger end of the truncated conic ejecting unit. The driving head has a driving block which are arranged at an axial direction of the driving head for installing a socket or other driving assembly. A switch unit is installed in the driving head. The switch unit has a control end projected from the driving portion and a resisting end.

3 Claims, 10 Drawing Sheets

RETURNING ASSEMBLY OF SPANNER

FIELD OF THE INVENTION

The present invention relates to spanners, and in particular to a returning assembly of a spanner, wherein an ejecting unit has a truncated conic shape so as to provide a preferred positioning effect to the spanner and thus the lifetime of the returning assembly is prolonged.

BACKGROUND OF THE INVENTION

Spanners with returning functions are more and more popular currently. Furthermore, ratchetless spanners with returning functions have the advantages of lower noise and easy operation and thus they are the main trend in hand tools.

Current ratchetless spanner has a round cylinder as an ejecting unit in returning operation. The cylinder may cause the driving head to resist against an inner wall of a driving portion. However in this prior art, the round cylinder has an equal diameter in the longitudinal direction. No variation is in the radial direction and thus the positioning of the round cylinder is bad. It easily shifts and thus the positioning effect is not preferred.

Furthermore, since the round cylinder has an equal diameter, it cannot modify in wearing so that the cylinder will deform gradually in use. Thereby the returning function will lose due to the deformation of the round cylinder.

SUMMARY OF THE INVENTION

Accordingly, the primary object of the present invention is to provide a returning assembly of a spanner, wherein an ejecting unit has a truncated conic shape so as to provide a preferred positioning effect to the spanner and thus the lifetime of the returning assembly is prolonged.

To achieve above objects, the present invention provides a returning assembly of a spanner. The returning assembly includes a driving portion having a receiving space for receiving a driving head, a switch unit and an ejecting unit having a truncated conic shape; a radial direction of the driving head having a slightly inclined buckling surface; the buckling surface and an inner wall of the receiving space being formed with a semilunar buckling space for receiving the ejecting unit; the ejecting unit serving for controlling the returning directions of the driving head. A round cylindrical positioning portion is extended from the larger end of the truncated conic ejecting unit; and the buckling space has a shape corresponding to that of the ejecting unit. The driving head is formed of an outer cover and a ring which are received in the receiving space of the driving portion. The driving head has a driving block which are arranged at an axial direction of the driving head for installing a socket or other driving assembly. A switch unit is installed in the driving head; the switch unit has a control end projected from the driving portion and a resisting end in the driving portion. The action of the resisting end is controlled by the operation of the control end. The resisting end of the switch unit resists against the ejecting unit in the buckling space. The shift of the ejecting unit is controlled by the control end so as to operate the resisting end to control the returning operation of the driving head.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
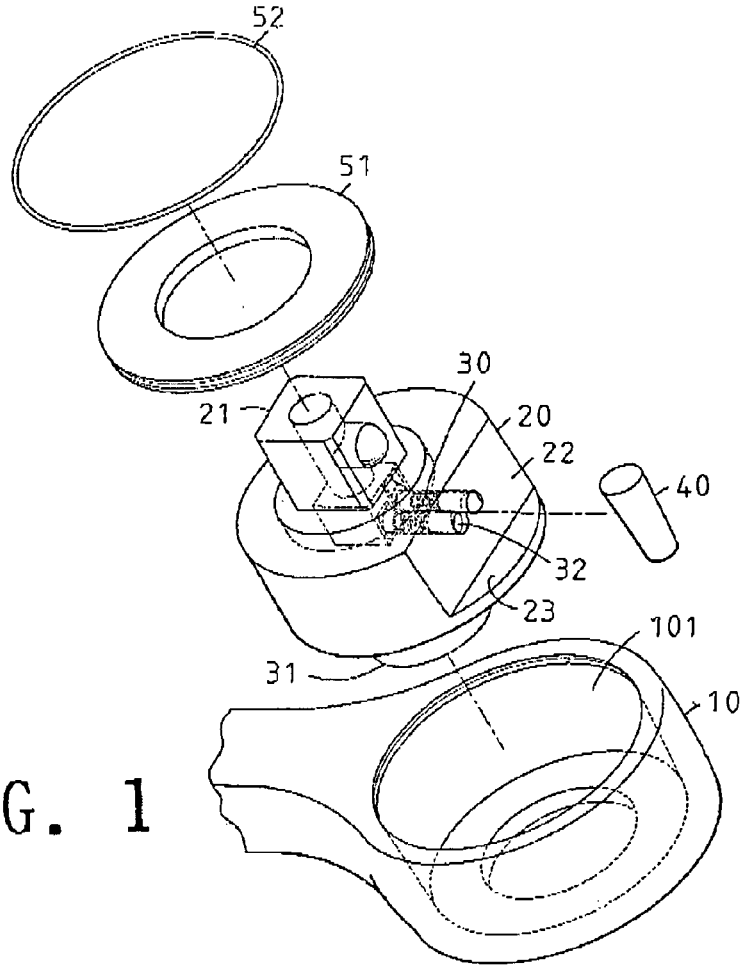
FIG. 1 is an exploded perspective view of the present invention.
Figure 2:
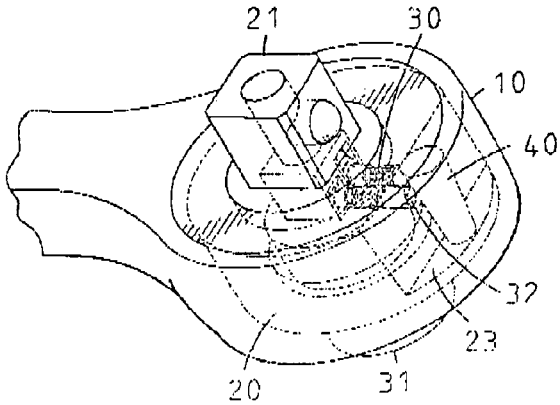
FIG. 2 is a perspective view of the present invention.

Referring to FIGS. 1 to 2, a returning assembly of a spanner of the present invention is illustrated. In the present invention, the ratchetless spanner is used as an example. The present invention has the following elements.

A driving portion 10 has a receiving space 101 for receiving a driving head 20, a switch unit 30 and an ejecting unit 40 having a truncated conic shape.

The driving head 20 is formed of an outer cover 51 and a ring 52 which are received in the receiving space 101 of the driving portion 10. The driving head 20 has a driving block 21 which are arranged at an axial direction of the driving head 20 for installing a socket or other driving assembly. A radial direction of the driving head 20 has a slightly inclined buckling surface 22. The buckling surface 22 and an inner wall of the receiving space 101 is formed with a semilunar buckling space 23 for receiving an ejecting unit 40. The switch unit 30 is installed in the driving head 20. The switch unit 30 has a control end 31 projected from the driving portion 10 and a resisting end 32 in the driving portion 10. The action of the resisting end 32 is controlled by the operation of the control end 31. The resisting end 32 of the switch unit 30 resists against the ejecting unit 40 in the buckling space 23. Thereby the user can shift the ejecting unit 40 by the control end 31 to operate the resisting end 32 so as to control the returning operation of the driving head 20. The assembly of the present invention is illustrated in FIG. 2. The operation and principle of the switch unit 30 is known in the prior art and the details will not be described herein.

Referring to FIGS. 3 to 12, one end of the ejecting unit 40 is enlarged and another end thereof has a small size so that the ejecting unit 40 has a truncated conic shape. The buckling space 23 is formed by the inclined buckling surface 22 and the inner wall of the receiving space 101 which is suitable for receiving the ejecting unit 40 having a truncated conic shape. The inner wall of the receiving space 101 and the: buckling surface 22 are inclined surfaces. Thereby the ejecting unit 40 can be accurately positioned in a predetermined position in the buckling space 23. Furthermore, the contact surface of the ejecting unit 40 and the buckling space 23 are parallel so that the returning operation can be positioned accurately.

Figure 3:
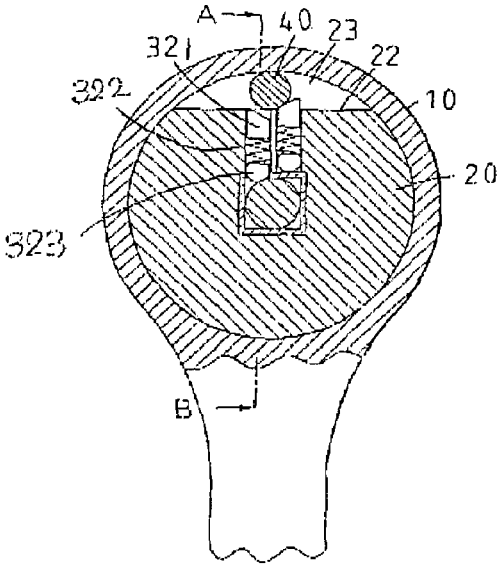
FIG. 3 is a cross sectional view showing the returning operation of the present invention.
Figure 4:
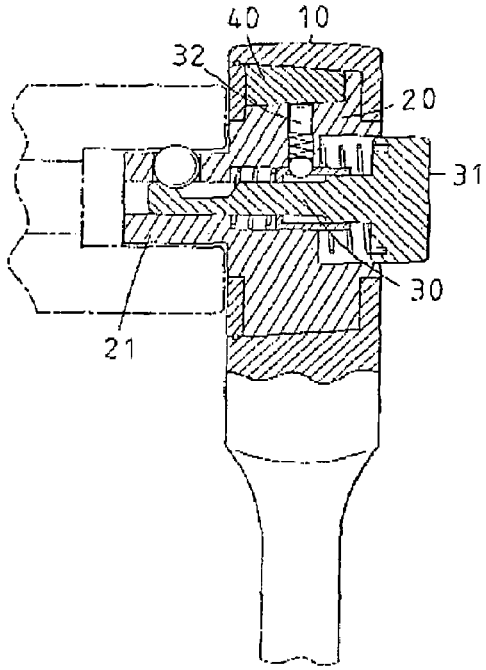
FIG. 4 is a cross sectional view along line AB in FIG. 3.

With reference to FIG. 3. when the ejecting unit 40 resists against the resisting end 32 of the switch unit 30, as the driving head 20 will rotate clockwise, it will resist against the ejecting unit 40 not to return to the original position. Thereby it can drive a screw means. When the driving head 20 rotates counterclockwise, the ejecting unit 40 will retract hack to the center portion of the buckling space 23. Thereby it can return to the original position. The resisting end 32 is formed by two sets of elastic units. Each elastic unit is formed with a ball, a spring and a block. The spring is arranged between the ball and the block. The block resists against a lateral wall of the ejecting unit 40; and the ball of one set of the elastic unit is fixed to a recess in the driving head 20; and the ball of another set of the elastic unit is protruded to the inner hollow space of the driving head 20. As the ejecting unit 40 extrudes the ball protruded to the inner hollow space will make the elastic unit to resist against the ejecting unit 40 so as to confine the operation of the ejecting unit.

Figure 5:
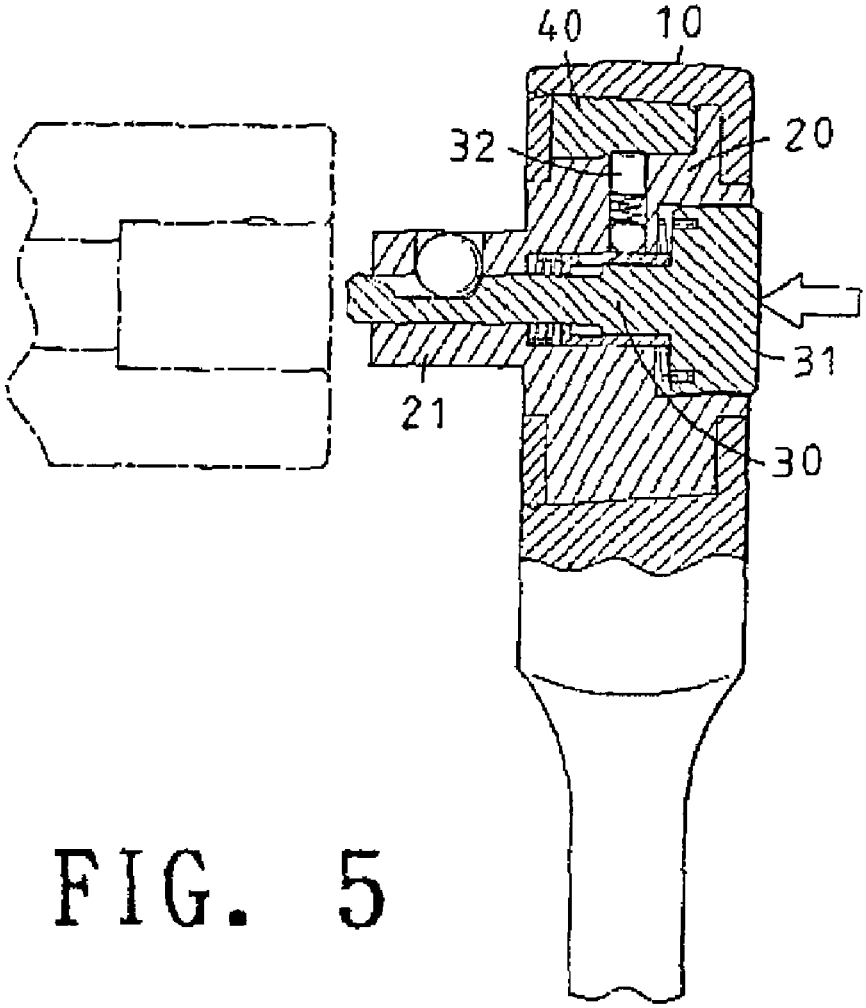
FIG. 5 is a schematic cross sectional view showing the switching operation of the present invention.

Referring to FIG. 5, when the user need change the returning direction, the user can press the control end 31 of the switch unit 30. Then the resisting end 32 of the switch unit 30 will change the shift direction of the ejecting unit 40.

Figure 6:
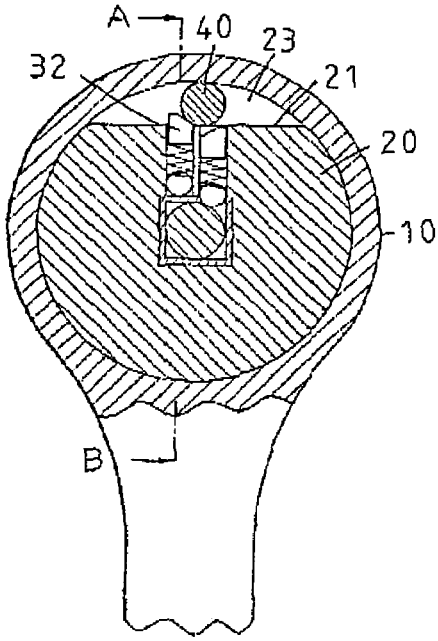
FIG. 6 is a cross sectional view about the returning operation of the present invention.
Figure 7:
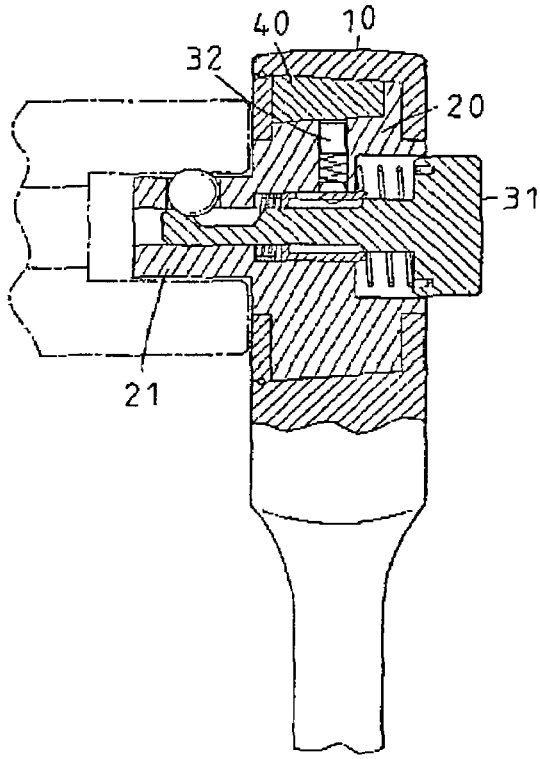
FIG. 7 is a cross sectional view along lie AB in FIG. 6.
Figure 8:
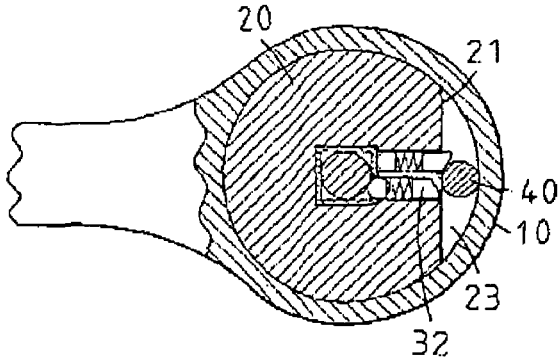
FIGS. 8 to 11 is a schematic cross sectional view about the 360 degree rotation of the ejecting unit in the returning operation.

With reference to FIG. 6, when the ejecting unit 40 is, pushed by the resisting end 32 of the switch unit 30 to move rightwards to a narrow space in the buckling space 23, the driving head 20 will rotate counterclockwise to resist against the ejecting unit 40. Thereby the driving head 20 can be used to drive a screw unit. When the driving head 20 rotates clockwise, the ejecting unit 40 will retract back to the central portion of the buckling space 23. Thus the returning effect is achieved.

Figure 9:
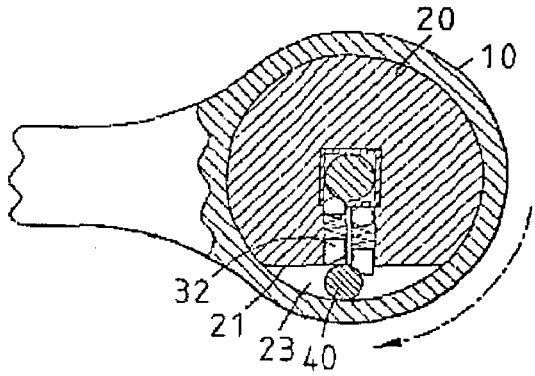
Figure 10:
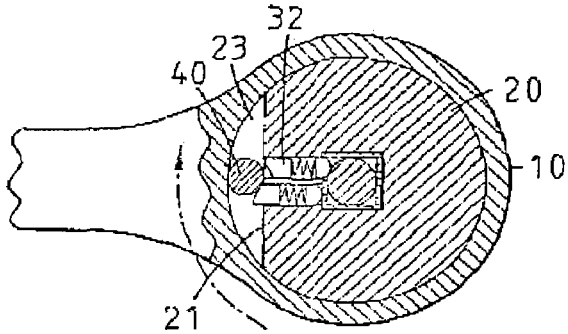
Figure 11:
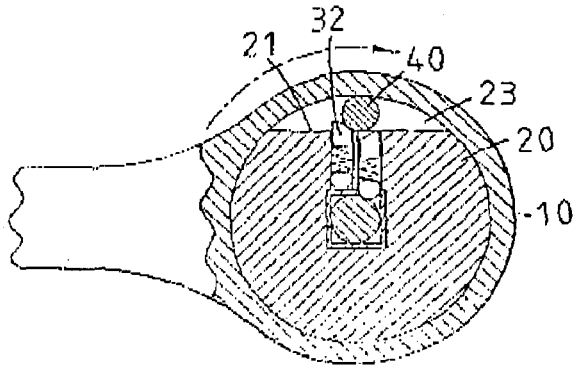

Referring to FIGS. 9 to 11, in returning to the original position, the ejecting unit 40 will be driven by the driving head 20 and the switch unit 30 to rotate through 360 degrees along the buckling space 23. Thus, forces are applied to different positions of the ejecting unit 40 and thus are not concentrated at some point of the ejecting unit 40. Thereby the lifetime of the ejecting unit 40 is prolonged.

Figure 12:
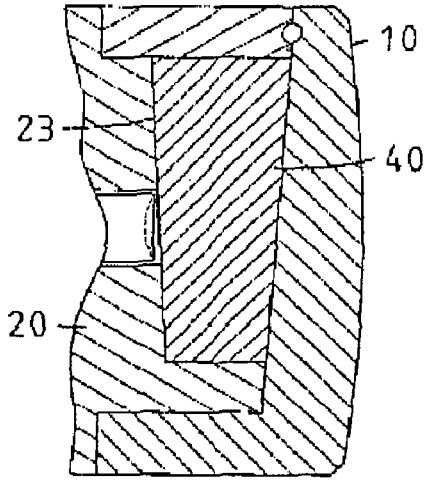
FIG. 12 is a schematic cross sectional view showing the ejecting unit and the buckling space of the present invention.
Figure 20:
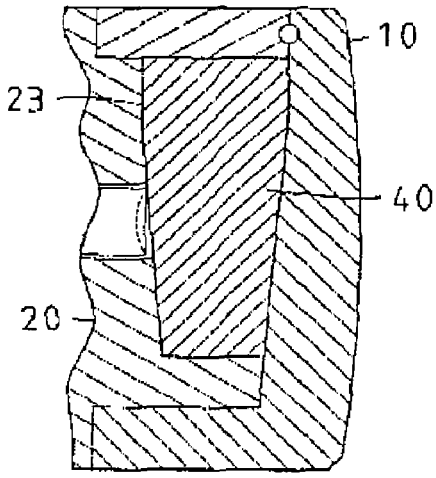
FIG. 20 is a schematic cross section view; showing the ejection unit and the buckling space arrangement in the second embodiment of the present invention.
Figure 13:
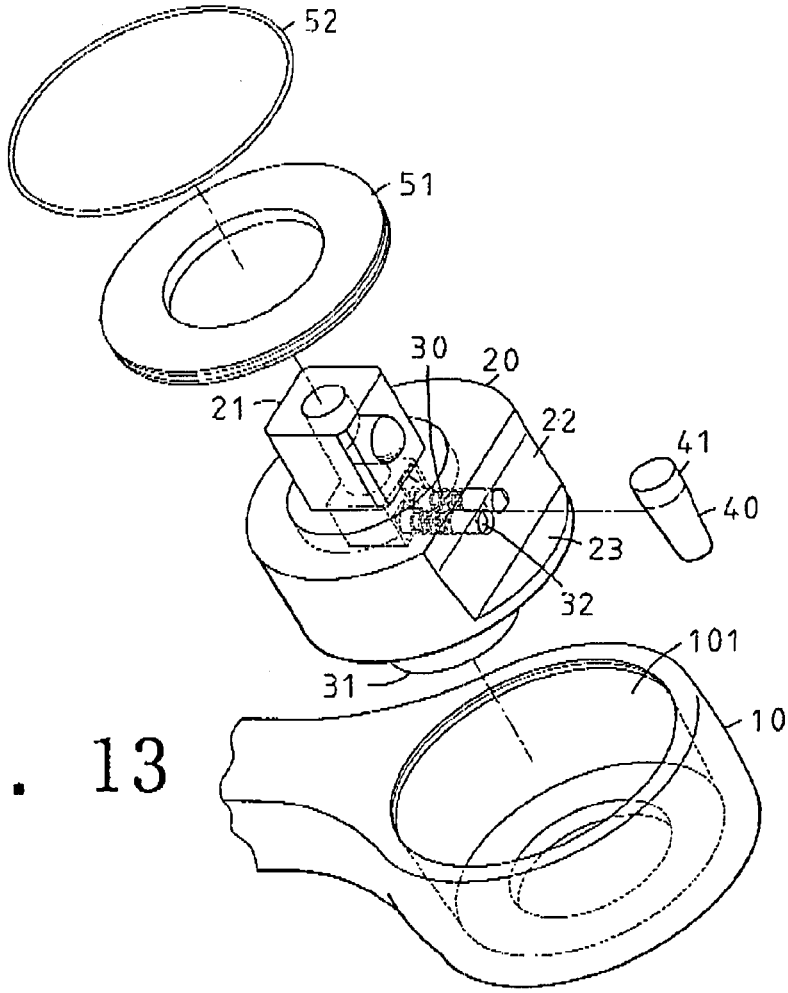
FIG. 13 is an exploded perspective view of the second embodiment of the present invention.
Figure 14:
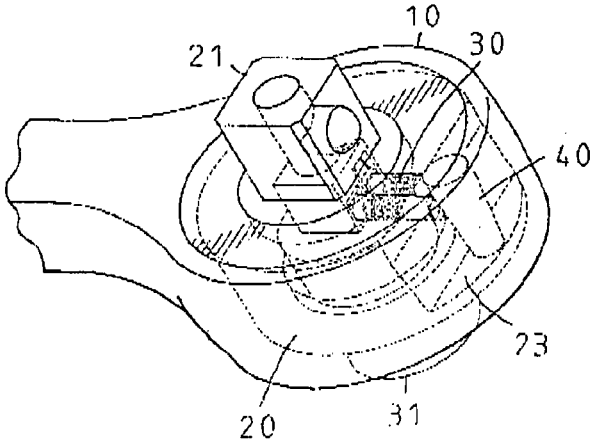
FIG. 14 is a perspective view of the second embodiment of the present invention.

Moreover, as shown in FIG. 12, in the present invention the ejecting unit 40 has a truncated conic shape. Furthermore, the inner wall of the receiving space 101 and the buckling surface 22 are inclined surface. Furthermore, the contact surface of the ejecting unit 40 and the buckling space 23 are parallel so as to have a preferred buckling effect.

As the ejecting unit 40 and the buckling space 23 are worn due to the resisting effect therebetween. The conic ejecting unit 40 has a smaller end. It can move in the smaller end of the buckling space 23 so that the ejecting unit 40 and the buckling space 23 tightly contact to one another. Thus the lifetime is prolonged.

With reference to FIGS. 13 to 20, the second embodiment of the present invention is illustrated. Those identical to the first embodiment will not be described. Only those differences are described.

To have preferred positioning effect between the ejecting unit 40 and the buckling space 23, a round cylindrical positioning portion 41 is extended from the larger end of the truncated conic ejecting unit 40. The buckling space 23 has a shape corresponding to that of the ejecting unit 40 so that the contact surfaces of the ejecting unit 40 and the inner wall of the buckling space 23 are parallel. Thus the ejecting unit 40 can be well positioned.

Figure 15:
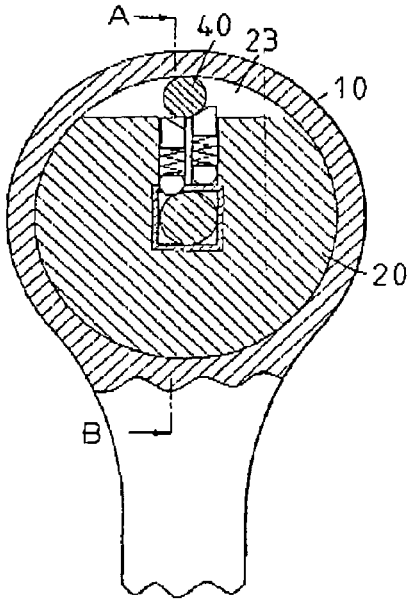
FIG. 15 is a cross sectional view of the second embodiment of the present invention, wherein a counterclockwise returning operation is illustrated.
Figure 16:
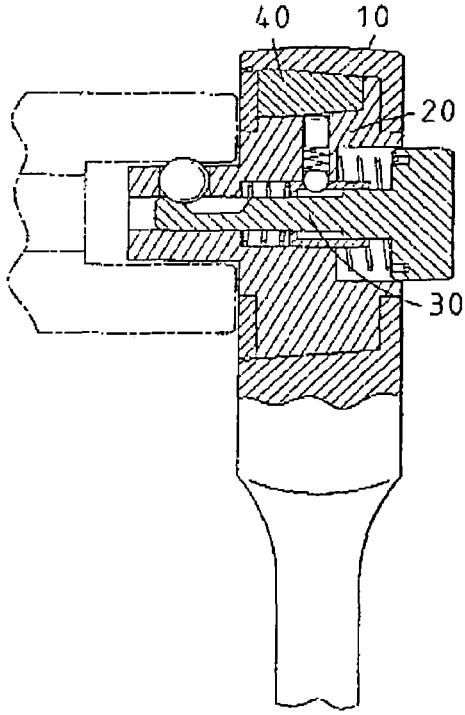
FIG. 16 is a cross sectional view along line AB of FIG. 15.
Figure 17:
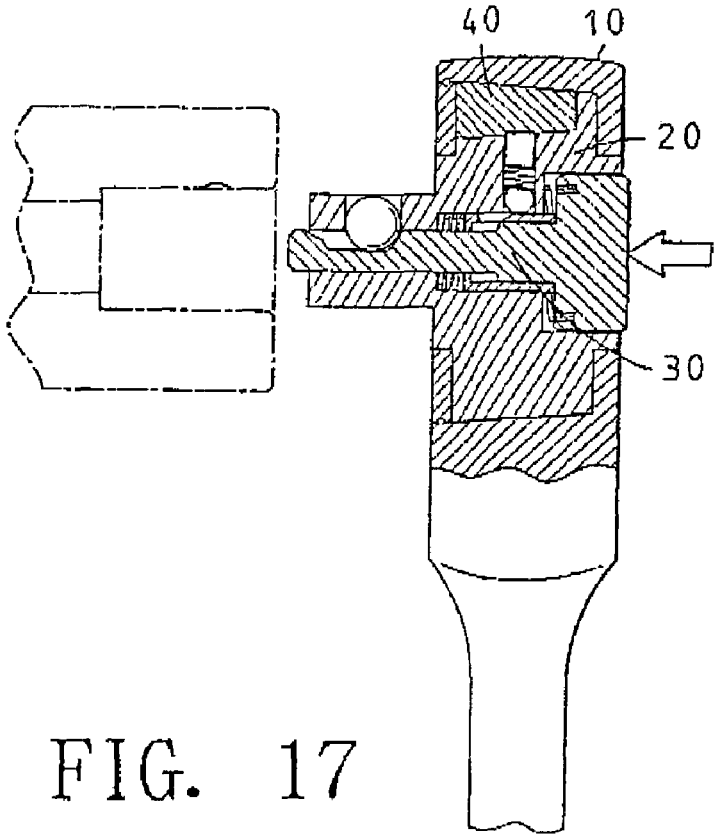
FIG. 17 is a schematic cross sectional view of the second embodiment of the present invention, wherein a switching state is illustrated.
Figure 18:
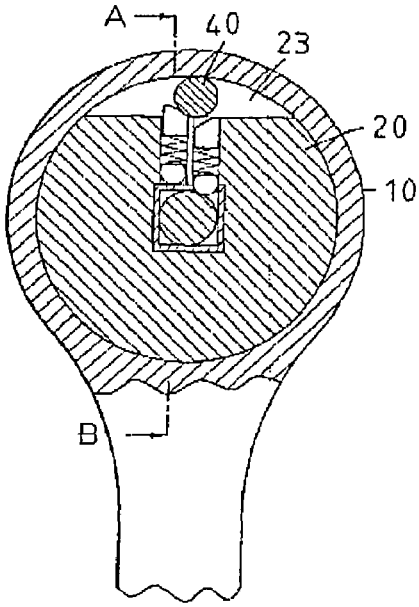
FIG. 18 is a schematic cross sectional view of the second embodiment of the present invention, a clockwise returning operation is illustrated.
Figure 19:
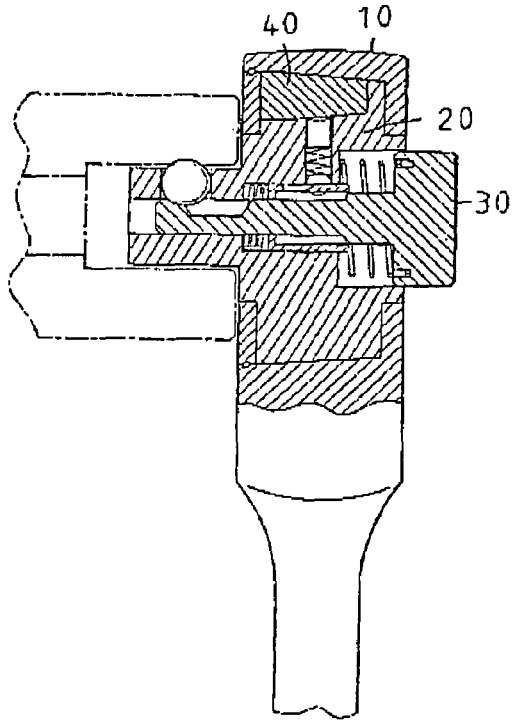
FIG. 19 is a cross sectional view along line AB of FIG. 18.

Referring to FIGS. 15, 17 and 18, as the ejecting unit 40 is added with the positioning portion, 41, not only having a positioning effect, but also the buckling and switching effects are achieved as those in the first embodiment.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A returning assembly of a spanner comprising:

a driving portion having a receiving space for receiving a driving head and an ejecting unit; and the ejecting unit having a truncated conic shape; and a radial direction of the driving head having an inclined buckling surface; the buckling surface and an inner wall of the receiving space being formed with a semi-lunar buckling space for receiving the ejecting unit; the ejecting unit serving for controlling the returning directions of the driving head; and wherein a switch unit is installed in an inner hollow space of the driving head; the switch unit has a control end projected from the driving portion and a resisting end in the driving portion; the action of the resisting end is controlled by the operation of the control end; the resisting end of the switch unit resists against the ejecting unit in the buckling space; the shift of the ejecting unit is controlled by, the control end so as to operate the resisting end to control the returning operation of the driving head; and wherein the resisting end is formed by two sets of elastic units; each elastic unit is formed with a ball, a spring and a block, the spring is arranged between the ball and the block; the block resists against a lateral wall of the ejecting unit; and the ball of one set of the elastic unit is fixed to a recess in the driving head; and the ball of another set of the elastic unit is protruded to the inner hollow space of the driving head; as the ejecting unit extrudes the ball protruded to the inner hollow space will make the elastic unit to resist against the ejecting unit so as to confine the operation of the electing unit.

2. The returning assembly of a spanner as claimed in claim 1, wherein a round cylindrical positioning portion 41 is extended from the larger end of the truncated conic ejecting unit 40; and the buckling space 23 has a shape corresponding to that of the ejecting unit 40.

3. The returning assembly of a spanner as claimed in claim 1, wherein the driving head 20 is formed of an outer cover 51 and a ring 52 which are received in the receiving space of the driving portion 10; the driving head 20 has a driving block 21 which are arranged at an axial direction of the driving head 20 for installing a socket or other driving assembly.

* * * * *